US005096513A

United States Patent [19]

Sawa et al.

[11] Patent Number: 5,096,513

[45] Date of Patent: Mar. 17, 1992

[54] VERY THIN SOFT MAGNETIC ALLOY STRIPS AND MAGNETIC CORE AND ELECTROMAGNETIC APPARATUS MADE THEREFROM

[75] Inventors: Takao Sawa, Yokohama; Masaaki Yagi, 2-12-8, Kagitori, Sendai-shi, Miyagi-ken, both of Japan

[73] Assignees: Kabushiki Kaisha Toshiba, Kawasaki; Masaaki Yagi, Sendai, both of Japan

[21] Appl. No.: 401,418

[22] Filed: Sep. 1, 1989

[51] Int. Cl.[5] ..... C22C 19/07; C22C 45/04

[52] U.S. Cl. ..... 148/304; 148/313; 428/611

[58] Field of Search ..... 148/304, 313, 403; 420/435, 440; 428/611

[56] References Cited

U.S. PATENT DOCUMENTS

| | | | |
|---|---|---|---|
| 4,154,283 | 5/1979 | Ray et al. | 164/64 |
| 4,265,682 | 5/1981 | Tsuya et al. | 148/112 |
| 4,859,256 | 8/1989 | Sawa et al. | 148/403 |
| 4,938,267 | 7/1990 | Hasegawa et al. | 148/403 |

FOREIGN PATENT DOCUMENTS

| | | | |
|---|---|---|---|
| 72574 | 2/1983 | European Pat. Off. . | |
| 86485 | 8/1983 | European Pat. Off. | 148/304 |
| 0271657 | 6/1988 | European Pat. Off. . | |
| 342921 | 11/1989 | European Pat. Off. . | |
| 2855858 | 7/1979 | Fed. Rep. of Germany | 148/304 |
| 3835986 | 5/1989 | Fed. Rep. of Germany . | |
| 58-44702 | 3/1983 | Japan . | |
| 61-123119 | 6/1986 | Japan | 148/304 |
| 62-046900 | 3/1987 | Japan . | |
| 63-96904 | 4/1988 | Japan . | |
| 63-135592 | 6/1988 | Japan . | |
| 63-135593 | 6/1988 | Japan . | |
| 63-302504 | 12/1988 | Japan . | |
| 82-01840 | 12/1982 | Netherlands | 148/304 |

OTHER PUBLICATIONS

Yagi et al., "Very Low Loss Ultrathin Co—based Amorphous Ribbon Cores," J. Appl. Phys. 64 (10), Nov. 15, 1988, pp. 6050-6052.

Yagi et al., "Ultra—Thin Amorphous Low Loss Cores for High Frequency Power Devices," 12th Annual Conference on Magnetics, 1988, p. 166.

Yagi et al., "Ultra—Thin Low Amorphous Ribbon Cores," IEE of Japan Magnetics Meeting MAG8-8—212, 1988, pp. 25-32.

Yagi, "Ultra—Thin Amorphous Alloy Cores," IEE of Japan Magnetics Meeting MAG85—186, 1985, pp. 41-48.

Sawa et al., "Properties of Amorphous Saturable Cores for High Frequency Application," 61st Magnetic Society of Japan Meeting, 1989, pp. 33-38.

Matsuura et al., "Effects of Ambient Gases on Surface Profile and Related Properties of Amorphous Alloy Ribbons Fabricated by Melt—Spinning," Japanese Journal of Applied Physics, vol. 19, No. 9, Sep. 1980, pp. 1781-1787.

Yagi et al., "High Freq. Power Loss in Ultra—Thin Co Base Amorphous Ribbon Cores," IEE of Japan Magnetics Meeting MAG—87—62, 1987, pp. 93-99.

H. H. Liebermann, "Manufacture of Amorphous Alloy Ribbons", IEEE Transactions on Magnetics, vol. MAG—15(1979) Nov., No. 6, pp. 1393-1397.

H. H. Liebermann, et al., "Dependence of Some Properties on Thickness of Smooth Amorphous Alloy Ribbon", Journal of Applied Physics, 55(1984) Mar., No. 6, Part IIA, pp. 1787 & 1789.

6001 Chemical Abstracts, vol. 92 (1980) Feb., No. 8, p. 682 Abstract No. 68684f.

*Primary Examiner*—R. Dean
*Assistant Examiner*—George Wyszomierski
*Attorney, Agent, or Firm*—Foley & Lardner

[57] ABSTRACT

A thin Co-based amorphous alloy strip is produced, the conditions for production being controlled to those specified by the invention. The thin strip has an extremely small thickness and few pinholes. The extremely small thickness of less than 4.8 μm notably enhances soft magnetic properties such as permeability and core loss in the high frequency range. Additionally, magnetic cores and electromagnetic apparatuses can be produced from the thin Co-based amorphous alloy strips.

14 Claims, 5 Drawing Sheets

VERY THIN SOFT MAGNETIC ALLOY STRIPS AND MAGNETIC CORE AND ELECTROMAGNETIC APPARATUS MADE THEREFROM

FIELD OF THE INVENTION AND RELATED ART STATEMENT

This invention relates to a method for the production of a very thin soft magnetic alloy strip suitable for use in a noise filter, a saturable reactor, a miniature inductance element for abating spike noise, main transformer, choke coil, a zero-phase current transformer, a magnetic head, etc., namely the devices which are expected to exhibit high levels of permeability at high frequencies, a very thin soft magnetic alloy strip by the use of the method, and an apparatus for the production of a soft magnetic alloy strip.

In recent years, higher performance has been required for magnetic parts used as important functional parts in electronic devices in order to match the higher performance, miniaturization and weight reduction of such devices. The magnetic materials to be used in such magnetic parts, as a natural consequence, are urged to possess outstanding magnetic properties. Particularly, materials of high permeability are effective in numerous magnetic parts such as current sensors in zero-phase current transformers and noise filters, for example.

In the case of a noise filter, for example, a switching power source is widely used as a stabilizing power source for electronic equipment and devices. In the switching power source, adoption of a measure for the abatement of noise constitutes itself an important task. The high-frequency noise having a switching frequency as its basic frequency and the noise of the MHz range issuing from a load such as, for example the logic circuit of a personal computer pose a problem.

For the abatement of the conducted noise of this kind, therefore, a common mode choke coil has found acceptance for use as a noise filter. When this filter is inserted in a power source line, the magnitude of the noise output voltage relative to the noise input voltage has such bearing on the permeability of a magnetic core that the noise output voltage decreases in proportion as the permeability increases. Further, the filter is required to function effectively not only in the low frequency range but equally in the high frequency range exceeding 1 MHz. For this reason, the frequency characteristic of the permeability is required to be favorable as well.

In recent years, the switching power source of the kind incorporating a magnetic amplifier has been finding widespread utility.

The main component in the magnetic amplifier is a saturable reactor and is claimed to require a magnetic core material excelling in the angular magnetization characteristic. The aforementioned trend of recent electronic machines and devices toward reduction in size and weight and enhancement of quality performance has been strongly urging switching power sources to attain generous reduction in size and weight. For the realization of the reduction in size and weight, there has been expressed a desire to heighten the switching frequency as much as possible. In the circumstances, the magnetic core material as one of the component parts of the saturable reactor is strongly desired to suffer from as small loss in the high frequency range as possible.

A proprietary product (by trademark designation) made of a Fe-Ni crystalline alloy and found utility to date is far short of fitting use in the high frequency range because it suffers from a notably increase of eddy-current loss in a high frequency range exceeding 20 kHz. The magnetic core material using an amorphous alloy capable of exhibiting a low core loss and a high angular shape ratio in the high frequency range is actually used only in a frequency range approximately in the range of 200 to 500 kHz because it entails an increased core loss in the MHz range.

Generally, in the case of metallic materials, it has been known that the core loss can be curbed and the high-frequency characteristic improved by decreasing the plate thickness. Even in the case of amorphous alloys, the feasibility of decreasing the plate thickness is being studied. Thin amorphous alloy strips are generally manufactured by the liquid quenching method which resorts to the single roll technique. Under the conventional production condition, in the case of Fe-based amorphous alloy, such thin strips have the largest possible thickness approximately in the range of 11 to 12 μm. On the other hand, in the case of Co-based amorphous alloy, the thickness of 5 μm could be obtained by the single roll technique in vacuum J.Appl, Phys. 64 6050, etc. However, it was thought that it was substantial impossible to make the thickness thinner than 5 μm. These thin strips contain relatively numerous pinholes because they entrain bubbles with themselves during the reduction of plate thickness and, therefore, pose problems on practicability as well as adaptability for higher frequency. For perfect realization of a switching frequency in the MHz range, the desirability of further decreasing the plate thickness has been finding enthusiastic recognition. However, it was thought that this desire could not be realized practically.

Recently, a Fe-based microcrystalline alloy possessing a practically equal soft magnetic property as amorphous alloys has been reported EPO Publication No. 0271657, Japanese patent Publication SHO 63(1988)-302, 504, etc. This alloy is produced by causing a Fe-Si-B type alloy, for example, to incorporate therein Cu and one element selected from among Nb, W, Ta, Zr, Hf, Ti, Mo, etc., forming the resultant alloy tentatively as a thin strip similarly to any amorphous alloy, and thereafter heat-treating the thin amorphous strip in a temperature range exceeding the crystallizing temperature thereof thereby inducing formation of ultrafine crystalline grains.

Even in the case of the Fe-based microcrystalline alloy of the nature described above, for the purpose of improving the high frequency property by decreasing the plate thickness thereby effecting crystallization of a thin strip of amorphous alloy, it is necessary that the thin amorphous strip should be produced in a fine state destitute of a pinhole. The existing manufacturing technique such as of the single-role principle, however, has never been successful in turning out a product fully conforming with the recent trend toward higher frequency. Further, since in the case of the Fe-based microcrystalline alloy microcrystalline grains are formed, the thin strip is brittle. Therefore, from quality point of view, it entails the important problem that it tends to sustain chipping and other similar defects during the process of manufacture as like core making. Likewise from this point of view, the desirability of mending the brittleness has been finding growing recognition.

As described above, the magnetic material for various kinds of magnetic cores is expected to manifest high permeability and low core loss at varying levels of frequency up to the high frequency range (to MHz range). This requirement leads electronic machines and devices toward further improvement of efficiency and further reduction in size and weight and magnetic cores toward reduction of size and improvement of quality.

OBJECT AND SUMMARY OF THE INVENTION

An object of this invention, therefore, is to provide a method for the production of an extremely thin amorphous alloy strip which fulfills the magnetic properties mentioned above and maintains a fine state destitute of such defects as pinholes.

Another object of this invention is to provide an extremely thin amorphous alloy strip which is capable of manifesting high permeability and low core loss in varying levels of frequency up to the high frequency range (to MHz range).

A further object of this invention is to provide a method for the production of an extremely thin Fe-based microcrystalline alloy strip which fulfills the magnetic properties mentioned above and has few pinholes.

Yet another object of this invention is to provide an extremely thin amorphous alloy strip which is capable of manifesting high permeability and low core loss in varying levels of frequency up to the high frequency range (to MHz range) and which exhibits enhanced resistance to embrittlement.

Still another object of this invention is to provide an apparatus for the production of a thin soft magnetic alloy strip, which apparatus is capable of producing an extremely thin amorphous alloy strip which fulfills the magnetic properties mentioned above and has few pinholes.

To accomplish the objects described above, the first aspect of this invention is directed to a method for the production of a thin soft magnetic alloy strip, comprising the steps of ejecting a molten alloy through a nozzle onto the surface of a rotating cooling member and rapidly quenching the ejected molten alloy thereby producing a thin amorphous alloy strip, which method is characterized by wholly fulfilling the following conditions.

Specifically, the conditions are as follows:

(1) A reduced pressure of not higher than $10^{-4}$ Torr should be used for the atmosphere in which the molten alloy infected through the nozzle travels until it impinges on the rotating cooling member.

(2) The rotary cooling member should be formed of a Fe-based alloy or a Cu-based alloy.

(3) The nozzle should be provided with an orifice of a rectangular cross section, the short side of which lying parallelly to the circumferential direction of the rotary cooling member should possess a length in the range of 0.07 to 0.13 mm.

(4) The distance between the nozzle and the rotary cooling member should be in the range of 0.05 to 0.02 mm.

(5) The pressure to be used for ejecting the molten alloy onto the rotary cooling member should be in the range of 0.015 to 0.025 kg/cm$^2$.

(6) The peripheral speed of the rotary cooling member should be in the range of 20 to 50 m/sec.

By the adoption of the method for production described above, it is made possible to provide a thin Co-based amorphous alloy strip possessing a thickness of less than 4.8 μm and consequently conforming with the trend toward higher frequency.

The Co-based amorphous alloy to be used in this invention is essentially represented by the following general formula:

$$(Co_{1-a}A_a)_{100-b}X_b \quad (I)$$

wherein A stands for at least one element selected from the class consisting of Fe, Ni, Cr, Mo, V, Nb, Ta, Ti, Zr, Hf, Mn, Cu, and the platinum-group elements, X for at least one element selected from the class consisting of Si, B, P, and C, and a and b for numbers satisfying the following formulas, $0 \leqq a \leqq 0.5$ (providing that $0 \leqq a \leqq 0.3$ is satisfied where Fe and Ni are excluded as A), 10 atomic $\% \leqq b \leqq 35$ atomic %.

The second aspect of this invention is directed to a method for the production of an extremely thin soft magnetic alloy strip by the steps of ejecting a molten alloy onto the surface of a rotating cooling member and rapidly quenching the ejected molten alloy thereby producing a thin Fe-based soft magnetic alloy strip, which method is characterized by wholly fulfilling the following conditions.

Specifically, the conditions are as follows:

(1) A reduced pressure of not higher than $10^{-2}$ Torr or an He atmosphere of a pressure of not higher than 60 Torrs should be used for the atmosphere in which the molten alloy ejected through the nozzle travels until it impinges on the rotating cooling member.

(2) The nozzle should be provided with an orifice of a rectangular cross section, the short side of which lying parallelly to the circumferential direction of the rotary cooling member should possess a length of not more than 0.20 mm.

(3) The distance between the nozzle and the rotary cooling member should be not more than 0.2 mm.

(4) The pressure to be used for ejecting the molten alloy onto the rotary cooling member should be not more than 0.03 kg/cm$^2$.

(5) The peripheral speed of the rotary cooling member should be not less than 20 m/sec.

By producing an extremely thin strip by rapidly quenching the molten alloy in accordance with the method for production described above heat-treating the quenched alloy strip at a temperature exceeding the crystallizing temperature of the alloy used, it is made possible to provide a thin Fe-based microcrystalline alloy strip having a thickness of not more than 10 μm and consequently conforming with the trend toward higher frequency and having educed therein ultrafine crystalline grains of a diameter of not more than 1,000 Å.

By performing the heat treatment at a temperature of lower than the crystallizing temperature, it is made possible to provide a thin Fe-based amorphous alloy strip possessing a thickness of not more than 10 μm and consequently conforming with the trend toward higher frequency.

The alloy to be used for the production of the aforementioned thin Fe-based soft magnetic alloy strip has a composition essentially represented by the following general formula:

$$Fe_{100-c-d}D_cY_d \quad (II)$$

wherein D stands for at least one element selected from the class consisting of the elements of Group IVa, the elements of Group Va, the elements of Group VIa, the rare-earth elements, Cu, Au, the platinum-group elements, Mn, Al, Ga, Ge, In, and Sn, Y for at least one element selected from the class consisting of Si, B, C, N, and P, and c and d for numbers satisfying the following formulas, $0 \leqq c \leqq 15$ and $15 \leqq d \leqq 30$. All numerical values in these formulas are represented by atomic %.

In the production of the thin Fe-based microcrystalline alloy strip, the alloy to be used therein has a composition essentially represented by the following formula:

$$Fe_{100-e-f-g-h-i-j}E_eG_fH_gSi_hB_iZ_j \quad \text{(III)}$$

wherein E stands for at least one element selected from the class consisting of Cu and Au, G for at least one element selected from the class consisting of the elements of Group IVa, the elements of Group Va, the elements of Group VIa, and rare-earth elements, J for at least one element of selected the class consisting of Mn, Al, Ga, Ge, In, Sn, and the platinum-group elements, Z for at least one element selected from the class consisting of C, N, and P, and e, f, g, h, i, and j for numbers satisfying the following formulas, $0.1 \leqq e \leqq 8$, $0.1 \leqq f \leqq 10$, $0 \leqq g \leqq 10$, $12 \leqq h \leqq 25$, $3 \leqq i \leqq 12$, $0 \leqq j \leqq 10$, and $15 \leqq h+i+j \leqq 30$.

All numerical values in these formulas are represented by atomic %.

In accordance with the method of this invention for the production of a very thin soft magnetic alloy strip, a thin Co-based amorphous alloy strip possessing a thickness of less than 4.8 μm, a thin Fe-based microcrystalline alloy strip possessing a thickness of not more than 10 μm, or a thin Fe-based amorphous alloy strip is obtained as described above. Since these alloy strips exhibit excellent soft magnetic properties such as permeability and core loss in the high frequency range, they can be offered as magnetic materials for use in a noise filer, a saturable reactor, a miniature inductance element for the abatement of spike noise, a zero-phase current transformer, a magnetic head, etc. which invariably demand excellent soft magnetic properties to be exhibited in the high frequency range.

In the case of the thin-Fe-based microcrystalline alloy strip, the phenomenon of embrittlement can be improved by having, the plate thickness decreased below 10 μm.

DETAILED DESCRIPTION OF PREFERRED EMBODIMENTS

Now, the present invention will be described more specifically below with reference to working examples.

Figure 1:
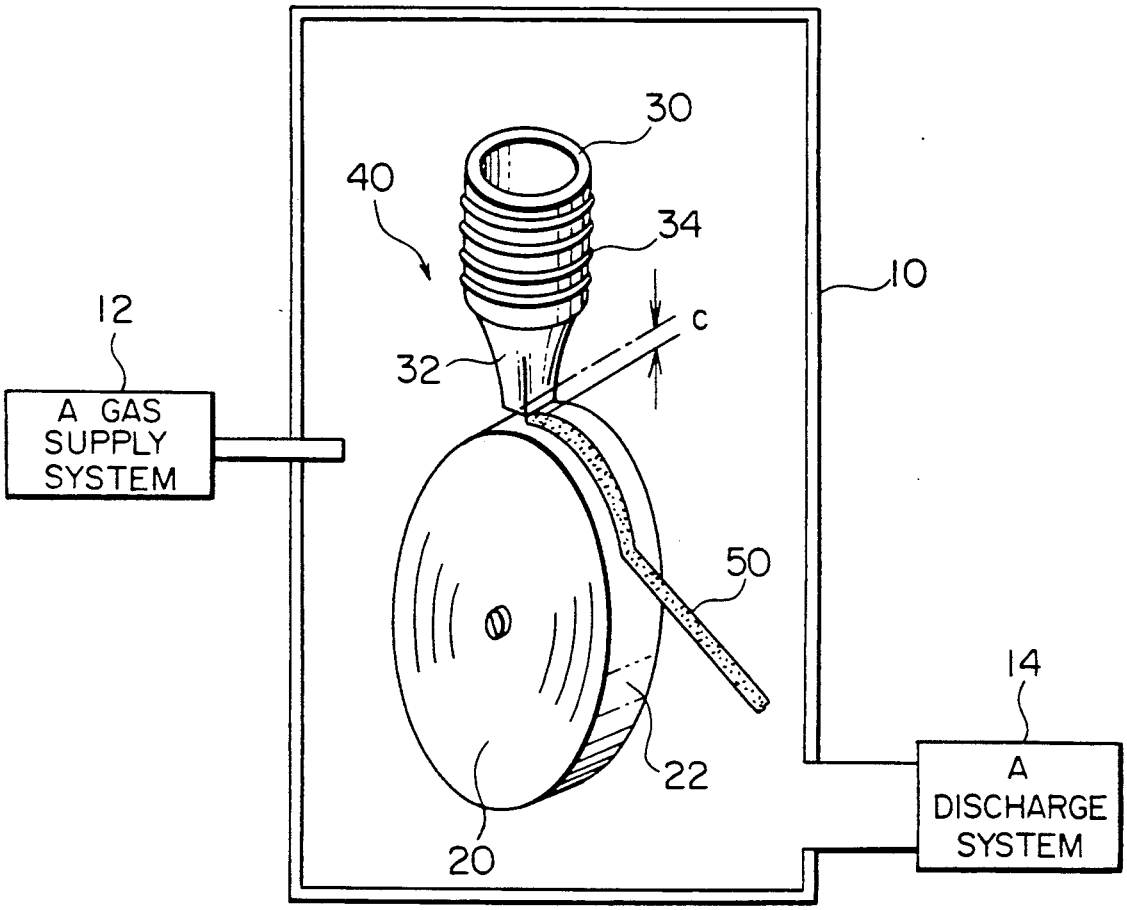
FIG. 1 is a diagram illustrating in model a typical construction of the apparatus for the production a thin soft magnetic alloy strip used in one embodiment of the present invention.

Now, the first aspect of this invention, namely the method for the production of an extremely thin soft magnetic alloy strip will be described in detail below. FIG. 1 is a diagram illustrating the construction of an apparatus for the production of a thin soft magnetic alloy strip embodying the method of this invention for the production of a thin soft magnetic alloy strip.

With reference to this diagram, a vacuum chamber 10 is provided with a gas supply system 12 and a discharge system 14. Inside this vacuum chamber 10, a single-roll mechanism 40 consisting mainly of a cooling roll 20 capable of being cooled to a prescribed temperature and controlled to a prescribed peripheral speed and a raw material melting container 30.

Figure 2:
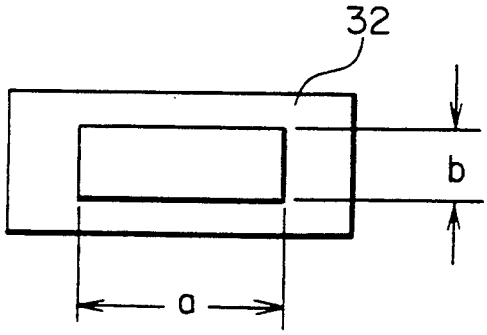
FIG. 2 is a diagram illustrating the shape of a nozzle for the apparatus from a bottom end view.
Figure 3:
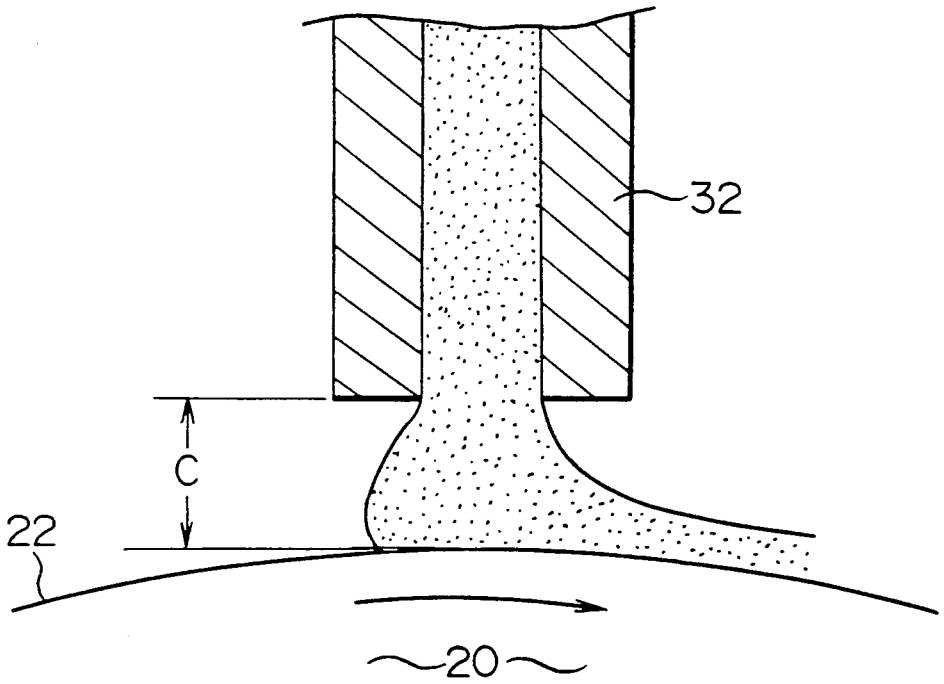
FIG. 3 is a diagram illustrating the nozzle and the cooling roll.

In the lower part of the raw material melting container 30 is disposed a nozzle 32 which opens in the direction of a peripheral surface 22 of the cooling roll 20. The shape of the orifice of this nozzle 32 is rectangular as illustrated in FIG. 2. The short side of the rectangular cross section of the orifice falls parallelly to the circumferential direction of the cooling roll 20. The long side a and the short side b of the orifice of the nozzle 32 are to be set in accordance with the particular raw material to be used. As showed in FIG. 3, the nozzle 32 are set so the appropriate distance c between the nozzle 32 and the peripheral surface 22 of the working roll 20 can be formed. This distance c can be varied depending on the particular raw material to be used. The angle of ejection onto the cooling roll 20 is not limited to 90°.

An induction heating coil 34 is disposed on the outer periphery of the raw material melting container 30 and is used for melting the raw material to be introduced. The molten raw material is ejected through the nozzle 32 onto the peripheral surface 22 of the cooling roll 20.

In producing an extremely thin Co-based amorphous alloy strip by the use of the apparatus for the production of a thin soft magnetic alloy strip constructed as described above, the raw material for a Co-based alloy composition represented by the aforementioned general formula:

$$(Co_{1-a}A_a)_{100-b}X_b \quad \text{(I)}$$

is first introduced into the raw material melting container 30 and melted therein.

In the composition of the formula (I) mentioned above, A represents an element which is effective in enhancing the thermal stability and improving the magnetic properties. When A is selected from among Mn, Fe, Ni, Cr, Mo, W, V, Nb, Ta, Ti, Zr, Hf, Cu, and the platinum-group elements, any value of a exceeding 0.3 is practically undesirable because this excess of the value goes to lower the Curie point. When A is Fe or Ni, any value of a exceeding 0.5 prevents the magnetic properties from being improved. X represents an element essential for the produced thin alloy strip to assume an amorphous phase. When the content of this element is less than 10 atomic % or not less than 35 atomic %, to obtain an amorphous phase becomes difficult.

Where the thin alloy strip is expected to possess particularly satisfactory high frequency properties so as to fit utility in a saturable reactor, a noise filter, main transformer, choke coil, or a magnetic head, for example, it is desirable to use a raw material of an alloy composition represented by the following general formula:

$$(Co_{1-m-n}L_mM_n)_{100-o}(Si_{1-p}B_p)_o \quad \text{(IV)}$$

wherein L stands for at least one element selected from the class consisting of Fe and Mn, M for at least on element selected from the class consisting of Ti, V, Cr, Ni, Cu, Zr, Nb, Mo, Hf, Ta, W and the platinum-group elements, and m, n, o, and p for numbers satisfying the following formulas, $0.03 \leqq m \leqq 0.15$, $0 \leqq n \leqq 0.10$, 20 atomic % $\leqq o \leqq$ 35 atomic % and $0.2 \leqq P \leqq 1.0$. Particularly the use of at least one element selected from among Cr, Mo, and W as M in the composition of the formula (IV) is effective in decreasing the thickness of the strip to extremity.

Then, the vacuum chamber 10 is evacuated to a reduced pressure of not higher than $10^{-4}$ Torr. The molten alloy composition is subsequently ejected under a pressure in the range of 0.015 to 0.025 kg/cm$^2$ through the nozzle onto the peripheral surface 22 of the cooling roll 20 operated at a controlled peripheral speed in the range of 20 to 50 m/sec, to rapidly quench the molten alloy and obtain a thin Co-based amorphous alloy strip 40.

The upper limit, $10^{-4}$ Torr, fixed for the pressure to be used for the atmosphere in which the molten metal is ejected is critical because the thin amorphous alloy strip 40 containing only very few pinholes and measuring less than 4.8 μm in thickness is not easily produced when the pressure is lower vacuum (worse) than $10^{-4}$ Torr. If the peripheral speed of the cooling roll 20 is less than 20 m/sec, the thin strip measuring less than 4.8 μm in thickness is obtained with difficulty. If the peripheral speed exceeds 50 m/sec, the possibility of the thin strip being broken during the course of production is increased and the production of the thin strip cannot be continued. Particularly where the thin strip measuring not less than 5 mm in width is to be produced, the peripheral speed is desired to be in the range of 20 to 40 m/sec, preferably 20 to 35 m/sec. If the pressure for the ejection of the molten metal is less than 0.015 kg/cm$^2$, it often happens that the ejection itself fails to occur. Conversely, if the pressure exceeds 0.025 kg/cm$^2$, the thin strip measuring less than 4.8 μm in thickness is produced only with difficulty.

The cooling roll 20 to be used herein is formed of a Fe-based alloy, preferably a Cr-containing Fe-based alloy such as, for example, tool steel. By the use of this cooling roll 20, the produced thin strip acquires improved surface smoothness and it is made possible to produce an extremely thin strip of fine state.

The long side a of the rectangular cross section of the orifice of the nozzle 32 functions to determine the width of the produced thin strip and has no specific restriction except for the requirement that they should measure not less than 2 mm. The short side b is an important factor for determining the thickness of the thin strip and is set in the range of 0.07 to 0.13 mm. If the short side b is less than 0.07 mm, the molten metal is ejected only with extreme difficulty. Conversely, if the short side b exceeds 0.13 mm, the thin strip measuring less than 4.8 μm in thickness cannot be produced. Preferably, the short side b is in the range of 0.08 to 0.12 mm.

Then, the distance c between the leading end of the nozzle 32 and the cooling roll 20 is set in the range of 0.05 to 0.20 mm. the reason for this range is that the thin strip is not easily obtained with desirable surface quality if this distance c is less than 0.05 mm and the thin strip measuring less than 4.8 μm is not obtained easily if this distance exceeds 0.20 mm.

By rapidly quenching the molten metal while fulfilling the conditions mentioned above, the thin Co-based amorphous alloy strip 40 measuring less than 4.8 μm can be obtained.

The thin Co-based amorphous alloy strip obtained as described above is coiled or superposed one ply over another to form a magnetic core, subjected to a heat treatment performed for the relief of strain at a temperature below crystallizing temperature to the Curie point, and then cooled. The cooling speed is required to fall in the range between 0.5° C./min and the speed of quenching in water, preferably in the range of 1° to 50° C./min. Thereafter, the cooled core may be given an additional heat treatment in the presence of a magnetic field (in the direction of the axis of the thin strip, the direction of the width, the direction of the plate thickness, or the rotary magnetic field) as occasion demands. The atmosphere in which this heat treatment is performed is not critical. An inert gas such as $N_2$ or Ar, a vacuum, a reducing atmosphere such as of $H_2$, or the ambient air may be used.

The reason for setting the limit of less than 4.8 μm for the thickness of the thin Co-based amorphous alloy strip is that the thin strip exhibits particularly desirable magnetic properties in the high frequency range of MHz, for example.

Now, typical examples of the manufacture of the thin Co-based amorphous alloy strip will be described below.

EXAMPLE 1

An alloy composition represented by the formula, $(Co_{0.95}Fe_{0.05})_{95}Mo_5)_{75}(Si_{0.5}B_{0.5})_{25}$, was prepared and placed in a raw material melting container and melted therein. The nozzle used herein had a rectangular orifice measuring 10.3 mm×0.10 mm (a×b) and the distance c between the nozzle and the cooling roll was 0.1 mm. The cooling roll was made of Fe.

Then, the vacuum chamber was evacuated to $5 \times 10^{-5}$ Torr and the molten alloy composition was ejected under pressure of 0.02 kg/cm$^2$ through the nozzle onto the peripheral surface of the cooling roll operated at a controlled peripheral speed of 33 m/sec, to rapidly quence the molten metal and produce a thin Co-based amorphous strip.

Thus, a long thin amorphous strip possessing satisfactory surface quality and measuring 4.7 μm in thickness and 10 mm in width was obtained.

The long very thin Co-based amorphous strip thus obtained was coiled, then subjected to the optimum heat treatment at a temperature below the crystallizing temperature, and tested for the frequency characteristic of initial permeability and for the high-frequency core loss.

Figure 4:
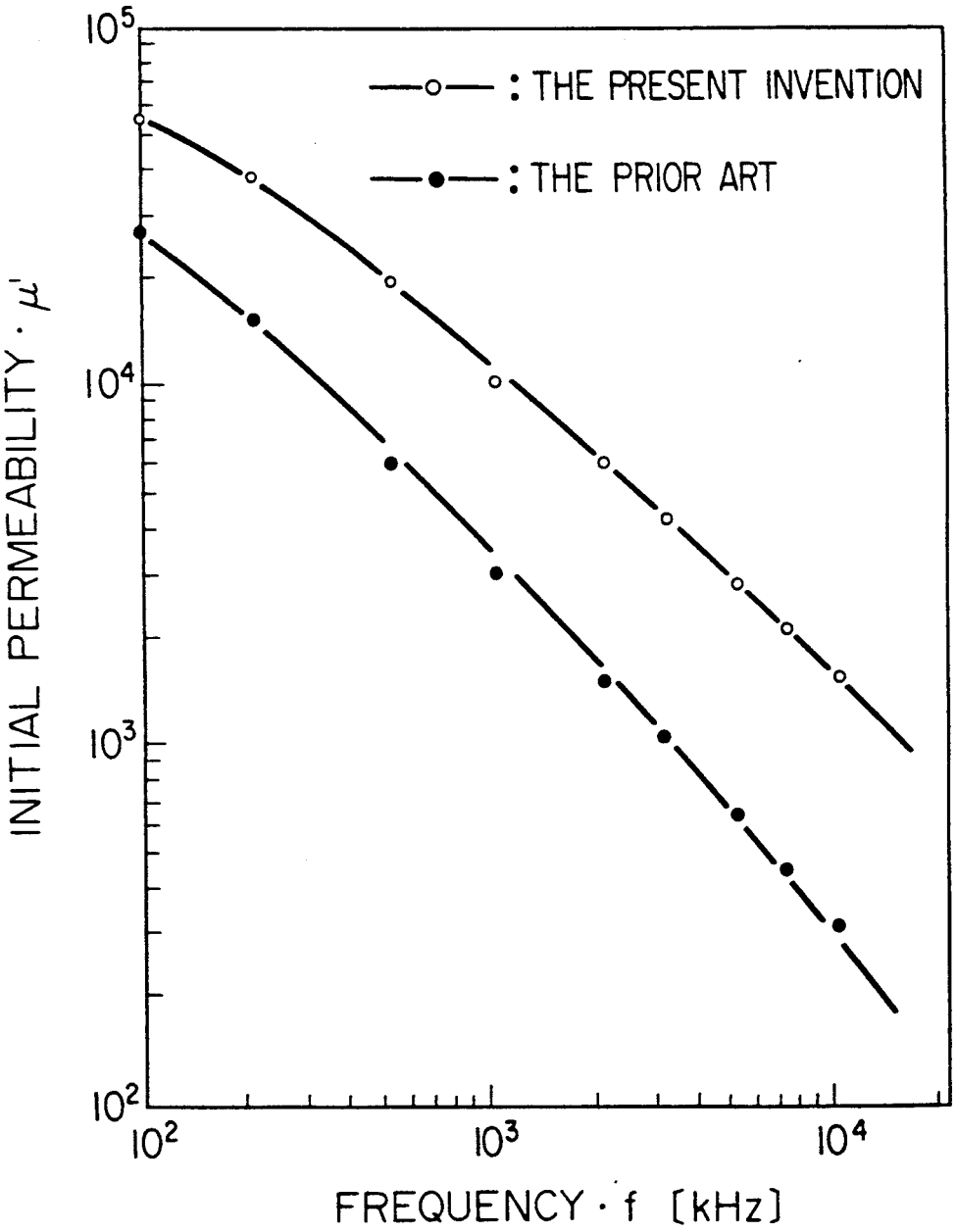
FIG. 4 is a graph showing the frequency characteristic of the initial permeability of a thin Co-based amorphous alloy strip produced in one embodiment of this invention, as compared with that of the conventional outertype.

FIG. 4 shows the frequency characteristic of initial permeability in an excited magnetic field of 2 mOe. For comparison, the results obtained similarly of a thin Co-based amorphous alloy strip using the same composition and measuring 15 μm in thickness are also shown in the diagram.

It is clearly noted from the diagram that the effect of the plate thickness conspicuously manifested when the permeability exceeded 100 kHz. The thin Co-based amorphous alloy strip 4.7 μm in thickness produced in the present example exhibited higher degrees of permeability at 1 MHz and 10 MHz than the thin strip produced for comparison, indicating that the thin strip of this invention exhibits highly satisfactory permeability even in the high frequency range.

The core loss of the thin strip of this example at 1 MHz under the condition of 1 kG of excited magnetic amplitude was about one half of that of the strip of a plate thickness of 15 μm. The rectangular ratio of the thin strip was almost 100% at a frequency above 500 kHz, indicating that this thin strip was useful in a saturable reactor, for example.

EXAMPLE 2

Thin Co-based amorphous alloy strips were produced by following the procedure of Example 1, excepting varying alloy compositions indicated in Table 1 were used as starting materials and varying conditions of manufacture similarly indicated in Table 1 were used.

Comparative experiments indicated in the same table produced thin strips of the same compositions as those of the example, with some or other of the manufacturing conditions of this invention deviated from the respective ranges specified by this invention.

TABLE 1

| | | Alloy composition | Degree of vacuum (Torr) | Orifice size of nozzle (a × bmm) | Material of roll | Peripheral speed of roll (m/sec) | Gap (cmm) | Injection pressure (kg/cm$^2$) | Plate thickness (μm) |
|---|---|---|---|---|---|---|---|---|---|
| Example 2 | Sample 1 | $(Co_{0.91}Fe_{0.05}Mo_{0.04})_{75}$ | $5 \times 10^{-5}$ | 15 × 0.10 | SKD roll | 36 | 0.10 | 0.02 | 4.0 |
| Comparative | Sample 1 | $(Si_{0.55}B_{0.45})_{25}$ | $5 \times 10^{-2}$ | " | " | " | " | " | 5.8* |
| Experiment | Sample 2 | | $5 \times 10^{-5}$ | 15 × 0.30 | " | " | " | " | 10.1 |
| 2 | Sample 3 | | " | 15 × 0.10 | Cu roll | " | " | " | 7.9 |
| | Sample 4 | | " | " | SKD roll | 17 | " | " | 7.6 |
| | Sample 5 | | " | " | " | 36 | 0.30 | " | 8.3 |
| | Sample 6 | | " | " | " | " | 0.10 | 0.05 | 6.5 |
| Example 2 | Sample 2 | $(Co_{0.91}Fe_{0.05}Cr_{0.04})_{75}$ | $5 \times 10^{-5}$ | 15 × 0.10 | SKD roll | 36 | 0.10 | 0.02 | 3.7 |
| Comparative | Sample 7 | $(Si_{0.6}B_{0.4})_{25}$ | $5 \times 10^{-2}$ | " | " | " | " | " | 5.5* |
| Experiment | Sample 8 | | $5 \times 10^{-5}$ | 15 × 0.30 | " | " | " | " | 9.8 |
| 2 | Sample 9 | | " | 15 × 0.10 | Cu roll | " | " | " | 7.7 |
| | Sample 10 | | " | " | SKD roll | 17 | " | " | 7.6 |
| | Sample 11 | | " | " | " | 36 | 0.30 | " | 8.0 |
| | Sample 12 | | " | " | " | " | 0.10 | 0.05 | 6.4 |
| Example 2 | Sample 3 | $(Co_{0.95}Fe_{0.05})_{74}$ | $5 \times 10^{-5}$ | 15 × 0.10 | SKD roll | 36 | 0.10 | 0.02 | 4.6 |
| Comparative | Sample 13 | $(Si_{0.6}B_{0.4})_{26}$ | $5 \times 10^{-2}$ | " | " | " | " | " | 6.8 |
| Experiment | | | | | | | | | |
| 2 | Sample 14 | | $5 \times 10^{-5}$ | 15 × 0.30 | " | " | " | " | 10.5 |
| | Sample 15 | | " | 15 × 0.10 | Cu roll | " | " | " | 8.9 |
| | Sample 16 | | " | " | SKD roll | 17 | " | " | 8.0 |
| | Sample 17 | | " | " | " | 36 | 0.30 | " | 9.6 |
| | Sample 8 | | " | " | " | " | 0.10 | 0.05 | 7.3 |
| Example 2 | Sample 4 | $(Co_{0.905}Fe_{0.05}Nb_{0.02}Cr_{0.25})_{75}$ | $8 \times 10^{-5}$ | 20 × 0.12 | SKD roll | 30 | 0.12 | 0.015 | 4.4 |
| | Sample 5 | $(Si_{0.5}B_{0.5})_{25}$ | $7 \times 10^{-5}$ | 25 × 0.10 | " | 25 | 0.15 | 0.020 | 4.0 |
| | Sample 6 | | $4 \times 10^{-5}$ | 30 × 0.09 | " | 25 | 0.15 | 0.020 | 3.7 |

*Pinholes contained

It is clearly noted from Table 1 that an extremely thin Co-based amorphous alloy strip measuring less than 4.8 μm in thickness and possessing a fine state devoid of a pinhole could not be obtained when any one of the conditions of manufacture deviated from the relevant range specified by this invention.

EXAMPLE 3

Thin strips were produced by following the procedure of Example 1, excepting an alloy composition represented by the formula, $(Co_{0.95}Fe_{0.05})_{95}Cr_5)_{75}$-$(Si_{0.5}B_{0.5})_{25}$, was used instead and the conditions of manufacture were varied from those of Example 1. Consequently, thin Co-based amorphous alloy strips measuring variously in the range of 3.0 to 10.2 μm in thickness. The thin strips had a fixed width of 5 mm.

Then, the thin amorphous alloy strips thus obtained were insulated with MgO, wound in the form of a toroidal core 12 mm in outermost diameter and 8 mm in inner diameter, annealed at a temperature not exceeding the crystallizing temperature and exceeding the curie point, and then cooled at a cooling speed of 3° C./min, to produce magnetic cores.

Figure 5:
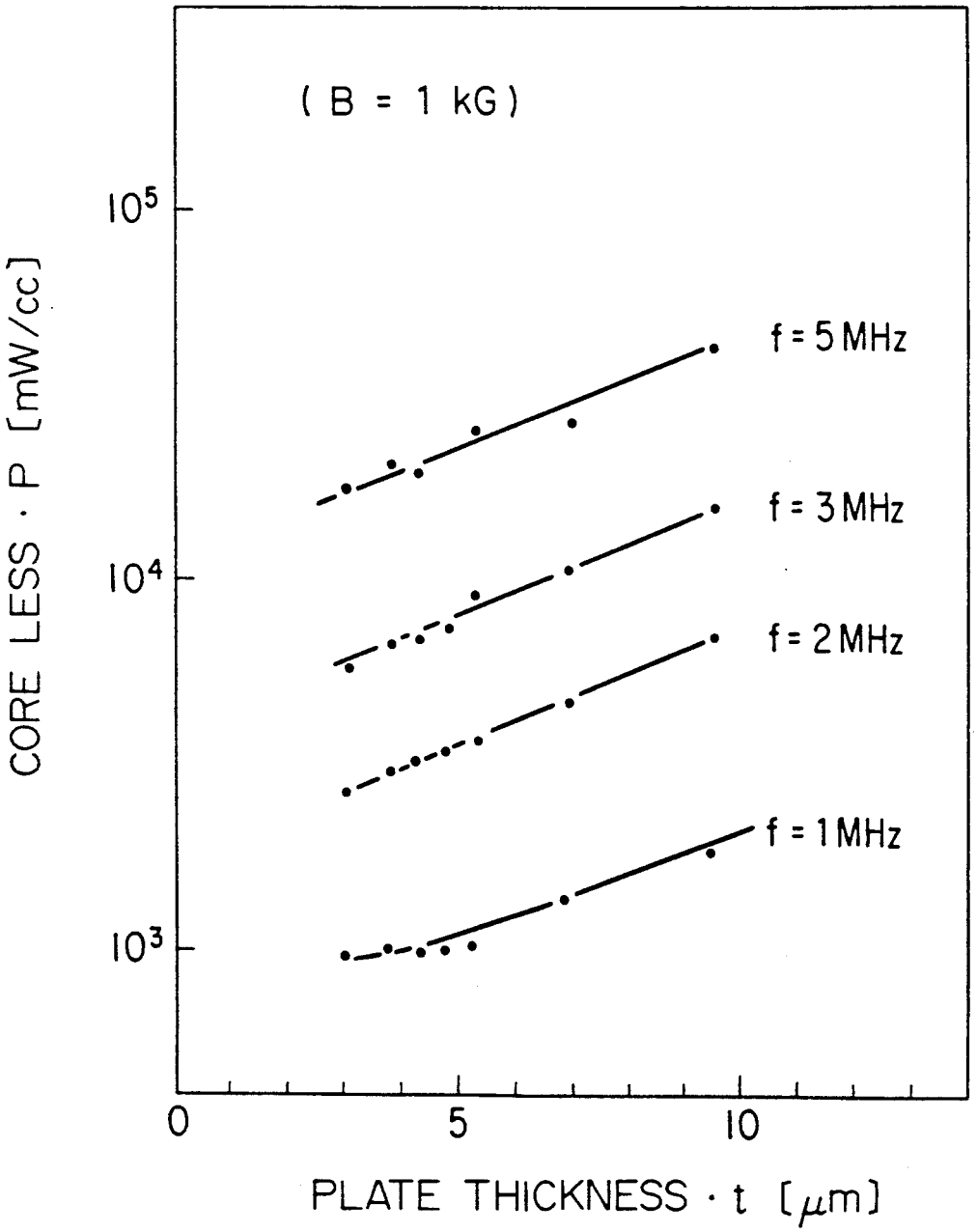
FIG. 5 is a graph showing core loss and the plate thickness of a thin Co-based amorphous alloy strip produced in another embodiment of this invention as the functions of frequency.

The magnetic cores thus obtained were tested for core loss at varying frequencies between 1 MHz and 5 MHz by the use of a magnetic property evaluating apparatus. The results were as shown in FIG. 5. During the test, the magnetic flux density was fixed at 1 KG.

It is clearly noted from the diagram that the core loss decreased in proportion as the plate thickness decreased and that in the magnetic flux density of 1 kG the core loss value of the plate thickness of less than 4.8 μm in f=2 MHz is smaller than the value in f=500 kHz (3(w/cc)), of the plate thickness of 20 μm Co-based amorphous alloy which is used practically at present time. It is indicated that these thin strips were highly advantageous for use in the high frequency range.

Now, the second aspect of this invention, namely the method for the production of an extremely thin soft magnetic alloy strip, will be described more specifically below. The apparatus used for this production was configured similarly to the apparatus of production illustrated in FIG. 1. The conditions for manufacture were different.

First, the raw materials for a Fe-based alloy composition represented by the aforementioned formula:

$$Fe_{100-c-d}D_cY_d \quad (II)$$

or, particularly for the production of a thin Fe-based microcrystalline alloy strip, the raw material for a Fe-based alloy composition represented by the general formula:

$$Fe_{100-e-f-g-h-i-j}E_eG_fJ_gSi_hB_iZ_j \quad (III)$$

was placed in the raw material melting container 30 and melted therein.

Here, D in the formula (II) shown above represents an element effective in the enhancement of thermal stability and the improvement of magnetic properties. Then, Y represents an element essential for the impartation of an amorphous texture to the thin strip. If the content of this element, Y, is less than 15 atomic % or exceeds 30 atomic %, the crystallizing temperature is unduly low and the sample obtained from the alloy composition is adulterated by inclusion of a crystalline portion.

Then, E (Cu or Au) in the aforementioned formula (III) represents an element effective in improvement of the corrosionresistance, preventing crystalline grains from being coarsened, and improving the soft magnetic properties such as core loss and permeability. It is particularly effective in the education of the bcc phase at low temperatures. If the amount of this element is unduly small, the effects mentioned above are not obtained. Conversely, if this amount is unduly large, the magnetic properties are degraded. Suitably, therefore, the content of E is in the range of 0.1 to 8 atomic %. Preferably, this range is from 0.1 to 5 atomic %.

G (at least one element selected from the class consisting of the elements of Group IVa, the elements of Group Va, the elements of Group VIa, and the rare-earth elements) is an element for effectively uniformizing the diameter of crystalline grains, diminishing magnetostriction and magnetic anisotropy, improving the soft magnetic properties, and also improving the magnetic properties against temperature changes. The combined addition of G and E (Cu, for example) allows the stabilization of the bcc phase to be attained over a wide range of temperature. If the amount of this element, G, is unduly small, the aforementioned effects are not attained. Conversely, if this amount is unduly large, the amorphous phase can not be obtained during the course of manufacture and, what is more, the saturated magnetic flux density is unduly low. The content of G, therefore, is suitably in the range of 0.1 to 10 atomic %. Preferably, this range is from 1 to 8 atomic %.

As concerns the effects of a varying element as E, in addition to the effects mentioned above, the elements of Group IVa are effective in widening the ranges of conditions of the heat treatment for the attainment of the optimum magnetic properties, the elements of Group Va are effective in improving the resistance to embrittlement and improving the workability as for cutting, and the elements of Group VIa are effective in improving the corrosionresistance and improving the surface quality.

Among the elements mentioned above, Ta, Nb, W, and Mo are particularly effective in improving the soft magnetic properties and V is conspicuously effective in improving the resistance to embrittlement and the surface quality. These elements are, therefore, constitute themselves preferred choices.

J (at least one element selected from the class consisting of Mn, Al, Ga, Ge, In, Sn, and the platinum-group elements) is an element effective in improving the soft magnetic properties or the corrosion resistant properties. If the amount of this element is unduly large, the saturated magnetic flux density is not sufficient. Thus, the upper limit of this amount is fixed at 10 atomic %. Among the elements of this class, Al is particularly effective in promoting fine division of crystalline grains, improving the magnetic properties, and stabilizing the bcc phase, Ge is effective in stabilizing the bcc phase, and the platinum-group elements are effective in improving the corrosion resistant properties.

Si and B are elements effective in obtaining amorphous phase during the course of manufacture, improving the crystallizing temperature, and promoting the heat treatment for the improvement of the magnetic properties. Particularly, Si forms a solid solution with Fe as the main component of microcrystalline grains and contributes to diminishing magnetostriction and magnetic anisotropy. If the amount of Si is less than 12 atomic %, the improvement of the soft magnetic properties is not conspicuous. If this amount exceeds 25 atomic %, the rapidly quenching effect is not sufficient, the educed crystalline grains are relatively coarse on the order of μm, and the soft magnetic properties are not satisfactory. Further, Si is an essential element for the construction of a super lattice. For the appearance of this super lattice, the content of Si is preferably in the range of 12 to 22 atomic %. If the content of B is less than 3 atomic %, the educed crystalline grains are relatively coarse and do not exhibit satisfactory properties. If this content exceeds 12 atomic %, B is liable to form a compound of B in consequence of the heat treatment and the soft magnetic properties are not satisfactory.

Optionally, as an element for promoting the conversion of the crystalline texture of the thin strip to the amorphous texture, Z (C, N, or P) may be contained in the alloy composition in an amount of not more than 10 atomic %.

The total amount of Si, B, and the element contributing to the conversion into the amorphous texture is desired to be in the range of 15 to 30 atomic %. For the acquisition of highly satisfactory soft magnetic properties, Si and B are desired to be sued in such amounts as to satisfy the relation, $Si/B \geqq 1$.

Particularly when the content of Si is in the range of 13 to 21 atomic %, the diminution of magnetostriction, λs, close to 0 is attained, the deterioration of the magnetic properties by resin mold is eliminated, and the outstanding soft magnetic properties aimed at are effectively manifested.

The effect of this invention is not impaired when the Fe-based soft magnetic alloy mentioned above contains in a very small amount such unavoidable impurities as 0 and S which are contained in ordinary Fe-based alloys.

Then, after the vacuum chamber 10 has been evacuated to a reduced pressure of not higher than $10^{-2}$ Torr or filled with a He atmosphere of not higher than 60 Torrs, the molten alloy composition is ejected under a pressure of not more than 0.03 kg/cm$^2$ through the nozzle 32 onto the peripheral surface of the cooling roll 20 operated at a controlled peripheral speed of not less than 20 m/sec, to quench the molted metal and produce a thin amorphous strip 40.

The reason for setting the upper limit of the reduced pressure or the pressure of the atmosphere of inert gas at $10^{-2}$ Torr or 60 Torrs is that particularly in the production of a thin strip of a large width exceeding 1.5 mm, the thin strip having a sufficient small thickness, excelling in surface quality, and containing no pinhole is obtained when the upper limit is not surpassed. If this upper limit is surpassed, the produced thin strip acquires a laterally undulating surface, abounds with pinholes, and fails to acquire a thickness of not more than 10 μm. The peripheral speed is required only to exceed 20 m/sec. In view of the facility of manufacture of the thin strip, however, this peripheral speed is desired to be not more than 50 m/sec. Then, the pressure for the ejection of the molten alloy is required only not to exceed 0.03 kg/cm$^2$, desirably not more than 0.025 kg/cm$^2$, and more desirably not more than 0.02 kg/cm$^2$. If this pressure is less than 0.001 kg/cm$^2$, the ejection of the molten metal is not easily attained.

The cooling roll 20 is desired to be made of a Cu-based alloy (such as, for example, brass). Where the plate thickness of the thin strip to be produced is not more than 8 μm, the cooling roll 20 may be made of a Fe-based alloy. The cooling roll made of the materials allows the produced thin strip to acquire improved surface quality and fine quality.

The long side a of the rectangular cross section of the orifice of the nozzle 32 determines the width of the produced thin strip. It is required only to exceed 2 mm. The short side b constitutes itself an important value for determining the plate thickness of the thin strip. For the sake of the production of this thin strip in an extremely small thickness of not more than 0.15 mm, the value of b is desired to be not more than 0.2 mm, preferably not more than 0.15 mm. In due consideration of the ejectability of the molten metal, however, the value of b is desired to be not less than 0.07 mm.

The distance c between the leading end of the nozzle 32 and the cooling roll 20 is not more than 0.2 mm. The reason for this upper limit is that the strip is not easily obtained in an extremely small thickness if this distance exceeds 0.20 mm. If this distance c is unduly small, the produced thin strip suffers from inferior surface quality. Thus, the distance is desired to be not less than 0.05 mm.

By quenching the molten metal faithfully under the conditions described above, the thin strip 40 of an amorphous state is obtained in a thickness of not more than 10 μm.

Where the thin Fe-based microcrystalline alloy strip is to be produced thereafter, the thin amorphous layer obtained as described above is subjected to a heat treatment at a suitable temperature exceeding the crystallizing temperature of the amorphous alloy for a period in the range of 10 minutes to 15 hours. This heat treatment allows the thin amorphous strip to effect precipitation of not more than 1000 Å microcrystalline grains and acquire improved magnetic properties. Optionally, the thin Fe-based microcrystalline alloy strip may be given an additional heat treatment in the presence of a magnetic field (in the direction of the axis of the thin strip, the direction of the width, the direction of the thickness, or in the rotary magnetic field). The kind of the atmosphere in which this heat treatment is carried out is not critical. The heat treatment effectively proceeds in the insert gas such as $N_2$ or Ar, in the vacuum, in the reducing atmosphere such as of $H_2$, or in the ambient air, for example.

The microcrystalline grains not more than 1,000 Å in diameter present in the thin Fe-based microcrystalline alloy strip obtained as described above are desired to be such that they exist therein in an area ratio in the range of 25 to 95%. If the area ratio of the microcrystalline grains is unduly small, namely if the area ratio of the amorphous is unduly large, the core loss is large, the permeability low, and the magnetostriction large. Conversely, if the area ratio of the microcrystalline grains is unduly large, the magnetic properties are unsatisfactory. The preferable ratio of presence of the microcrystalline grains in the alloy is in the range of 40 to 90% as area ratio. Within this range, the soft magnetic properties are obtained particularly stably.

The reason for setting the upper limit of the thickness of the thin Fe-based microcrystalline alloy strip at 10 μm is that the magnetic properties in the high frequency range such as of MHz are highly satisfactory and the resistance to embrittlement is improved when this upper limit is observed. The improvement of the resistance to embrittlement is prominent when the thickness is restricted below 8 μm.

In the production of the thin Fe-based amorphous alloy strip, the thin strip in an amorphous state is subjected to a heat treatment at a temperature not exceeding the crystallizing temperature of the amorphous alloy.

Now, the production of the thin Fe-based microcrystalline alloy strip will be described specifically below with reference to typical examples.

EXAMPLE 4

An alloy composition represented by the formula, $Fe_{72}Cu_1V_6Si_{13}B_8$, was prepared, placed in the raw material melting container, and melted therein.

The nozzle used herein had a rectangular orifice measuring 5.2 mm×0.15 mm (a×b). The distance c between the nozzle and the cooling roll was 0.15 mm. The cooling roll was made of a Cu alloy.

Then, after the vacuum chamber had been evacuated to $5\times10^{-5}$ Torr, the molten alloy composition was ejected under a pressure of 0.025 kg/cm$^2$ through the nozzle onto the peripheral surface of the cooling roll operated under a controlled peripheral speed of 42 m/sec, to quench the molten metal and obtain a thin strip.

The thin strip thus obtained measured 5 mm in width and 7.8 μm in thickness and possessed an amorphous state.

Then, the thin strip was wound in a toroidal core with 12 mm outermost diameter and 8 mm inner diameter). This core was subjected to a heat treatment in an atmosphere of $N_2$ at 570° C. for two hours.

The core after the heat treatment was measured for magnetic core loss, and frequency characteristic of initial permeability by the use of a U function meter and a LCR meter.

Figure 6:
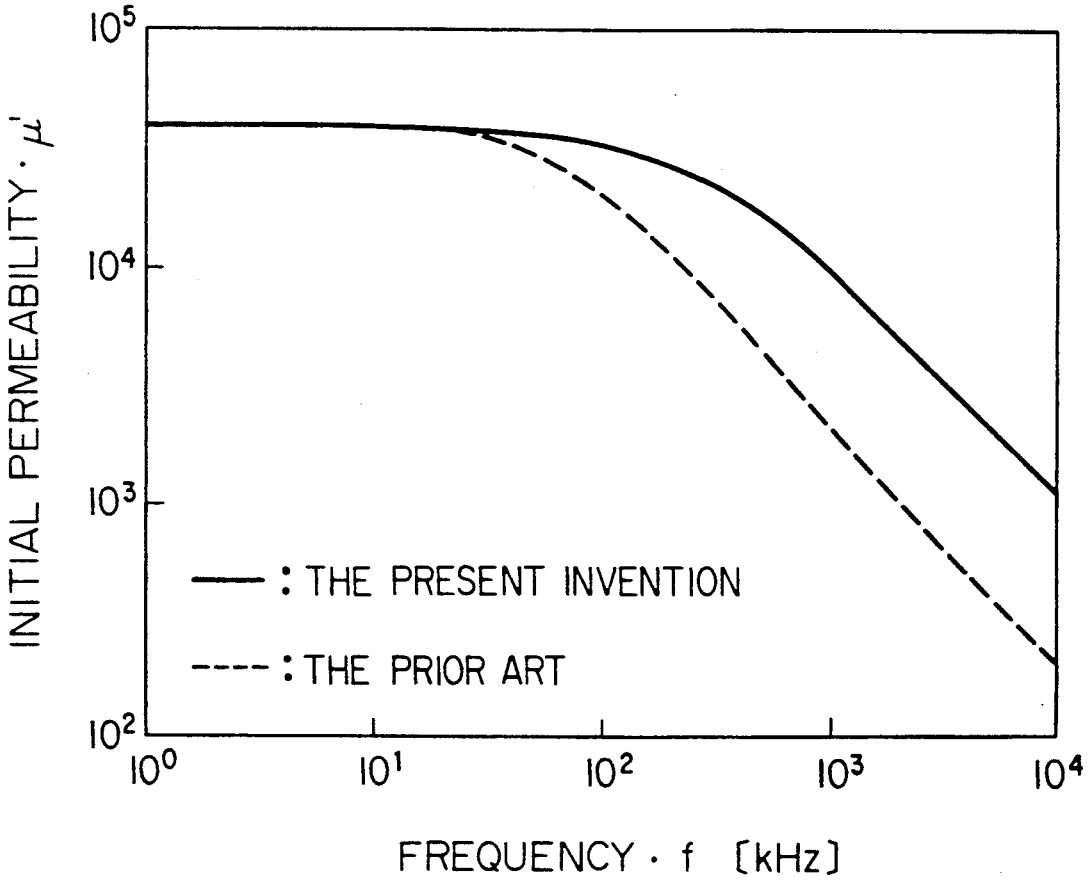
FIG. 6 is a graph showing the frequency characteristic of the initial permeability of a thin Fe-based microcrystalline alloy strip produced in yet another embodiment of this invention, as compared with that of the conventional countertype.

FIG. 6 shows the frequency characteristic of the initial permeability in an excited magnetic field of 2 mOe. For comparison, the results similarly obtained of a thin Fe-based microcrystalline alloy strip using the same alloy composition and possessing a thickness of 18 μm are shown in the diagram.

It is clearly noted from the diagram that the effect of plate thickness on permeability appeared conspicuously at a high frequency exceeding 100 kHz.

The test results on core loss were as shown in Table 2 below, indicating the extreme decrease in plate thickness was evidently effective.

TABLE 2

| | Plate thickness (μm) | Core loss (mW/cc) f = 100kHz B = 2 kG | Core loss (mW/cc) f = 1MHz B = 1 kG |
|---|---|---|---|
| Example 4 | 7.8 | 80 | 1350 |
| Comparative Experiment 4 | 18 | 350 | 4600 |

The thin Fe-based microcrystalline alloy strips of Example 4 and Comparative Experiment 4 were subjected to a bending test. This test was carried out by disposing a given thin heat-treated Fe-based microcrystalline alloy strip in a bent state between tow plates, narrowing the distance between the two plates until the bent sample broke, measuring the distance, l, between the two plates at the time of breakage of the sample, and calculating the following formula using the found distance $$\epsilon = \frac{t}{l - t}$$

(wherein t stands for the average thickness of the sample thin strip by gravimetric method based on $$\frac{\text{weight}}{\text{density} \times \text{length} \times \text{width}}\Big).$$

The value resulting from the calculation was $\epsilon = 5 \times 10^{-3}$ for the thin Fe-based microcrystalline alloy strip of Example 4 and $\epsilon = 2 \times 10^{-4}$ for that of Comparative Experiment 4. This fact clearly indicates that the resistance to embrittlement was improved by the extreme decrease of plate thickness. $\epsilon$ is not less than $1 \times 10^{-3}$, preferably not less than $3 \times 10^{-3}$.

EXAMPLE 5

Thin amorphous strips were produced by following the procedure of Example 4, excepting varying alloy compositions indicated in Table 3 were used instead and the conditions of production were varied as indicated in Table 3. Then, the thin strips were wound to produce cores and the cores were heat-treated similarly.

TABLE 3

| | | Alloy composition | Degree of vacuum (Torr) | Orifice size of nozzle (a × bmm) | Peripheral speed of roll (m/sec) | Gap (cmm) | Injection pressure (kg/cm²) | Plate thickness (μm) | Iron loss *1 (mW/cc) | Permeabilith *2 | Value of brittleness (ε) |
|---|---|---|---|---|---|---|---|---|---|---|---|
| Example 5 | Sample 1 | $Fe_{73}Cu_1Nb_4Si_{14}B_8$ | $8 \times 10^{-5}$ | 15 × 0.12 | 38 | 0.15 | 0.025 | 6.9 | 1240 | 1200 | $4.8 \times 10^{-3}$ |
| | Sample 2 | $Fe_{72}Cu_{1.5}Mo_3Si_{13.5}B_{10}$ | $1 \times 10^{-4}$ | 20 × 0.15 | 35 | 0.12 | 0.020 | 6.0 | 1120 | 1280 | $8.5 \times 10^{-3}$ |
| | Sample 3 | $Fe_{74}Cu_2Ta_4Si_{14}B_6$ | $5 \times 10^{-5}$ | 20 × 0.10 | 40 | 0.15 | 0.020 | 5.4 | 1030 | 1350 | $7.8 \times 10^{-3}$ |
| | Sample 4 | $Fe_{72}Cu_1W_3Si_{13}B_6$ | $2 \times 10^{-4}$ | 20 × 0.12 | 32 | 0.10 | 0.015 | 6.0 | 1150 | 1250 | $6.0 \times 10^{-3}$ |
| | Sample 5 | $Fe_{75}Cu_1Ti_5Si_{13}B_6$ | $5 \times 10^{-5}$ | 20 × 0.10 | 40 | 0.15 | 0.020 | 5.9 | 1100 | 1300 | $6.0 \times 10^{-3}$ |
| | Sample 6 | $Fe_{71}Cu_2Zr_5Si_{14}B_8$ | $5 \times 10^{-5}$ | 20 × 0.10 | 40 | 0.15 | 0.020 | 6.2 | 1100 | 1280 | $6.5 \times 10^{-3}$ |
| | Sample 7 | $Fe_{72}Cu_{0.8}Hf_4Si_{14}B_{9.2}$ | $8 \times 10^{-5}$ | 15 × 0.12 | 38 | 0.15 | 0.025 | 7.1 | 1300 | 1190 | $4.9 \times 10^{-3}$ |

*1 Under the conditions of 1MHz and 0.1T
*2. Under the conditons of 10MHz

It is clearly noted form Table 3 that thin Fe-based microcrystalline alloy strips of fine quality measuring not more than 10 μm in thickness and containing few pinholes were obtained by first preparing thin strips of an amorphous state under the conditions invariably falling in the ranges specified by this invention and then heat-treating these thin amorphous strips. It is also clear that they satisfied the requirements for low core loss and high permeability in the high frequency range.

What is claimed is;

1. An extremely thin soft magnetic alloy strip, having a plate thickness of less than 4.8 μm and an alloy composition substantially represented by the formula $(Co_{1-a}A_a)_{100-b}X_b$, wherein A is at least one element selected from the group consisting of Fe, Ni, Mn, Cr, Mo, W, V, Nb, Ta, Ti, Zr, Hf, Cu and platinum-group elements, X is at least one element selected from the group consisting of Si, B, P and C, a is a number satisfying $0 \leqq a \leqq 0.5$, and b is an atomic % satisfying $10 \leqq b \leqq 35$.

2. An extremely thin soft magnetic alloy strip according to claim 1, wherein A is at least one element selected from the group consisting of Mn, Cr, Mo, W, V, Nb, Ta, Ti, Zr, Hf, Cu and platinum-group elements, and a is a number satisfying $0 \leqq a \leqq 0.3$.

3. An extremely thin soft magnetic alloy strip according to claim 2, wherein A is selected from the group consisting of Cr, Mo and W.

4. A magnetic core comprising the extremely thin soft magnetic alloy strip according to claim 3, said magnetic core being formed by superposing at least two of the extremely thin soft magnetic alloy strips.

5. A magnetic core comprising the extremely thin soft magnetic alloy strip according to claim 1, said magnetic core comprising a winding of the extremely thin soft magnetic alloy strip.

6. A magnetic core comprising the extremely thin soft magnetic alloy strip according to claim 1, said magnetic core being formed by superposing at least two of the extremely thin soft magnetic alloy strips.

7. An extremely thin soft magnetic alloy strip, having a plate thickness of less than 4.8 μm and an alloy composition substantially represented by the formula $(Co_{1-m-n}L_mM_n)_{100-o}Si_{1-p}B_p)_o$, wherein L is at least one element selected from the group consisting of Fe and Mn, M is at least one element selected from the group consisting of Ti, V, Cr, Ni, Cu, Zr, Nb, No, Hf, Ta, W and platinum-group elements, m is an atomic ratio satisfying $0.03 \leqq m \leqq 0.14$, n is an atomic ratio satisfying $0 \leqq n \leqq 0.10$, p is a number satisfying $0.2 \leqq p \leqq 1.0$, and o is an atomic % satisfying $20 \leqq o \leqq 35$.

8. A magnetic core comprising the extremely thin soft magnetic alloy strip according to claim 7, said magnetic core comprising a winding of the extremely thin soft magnetic alloy strip.

9. A magnetic core comprising the extremely thin soft magnetic alloy strip according to claim 7, said magnetic core being formed by superposing at least two of the extremely thin soft magnetic alloy strips.

10. An electromagnetic apparatus comprising a magnetic core according to claim 5.

11. An electromagnetic apparatus comprising a magnetic core according to claim 8.

12. An electromagnetic apparatus comprising a magnetic core according to claim 6.

13. An electromagnetic apparatus comprising a magnetic core according to claim 9.

14. An electromagnetic apparatus comprising a magnetic core according to claim 4.

* * * * *

UNITED STATES PATENT AND TRADEMARK OFFICE

CERTIFICATE OF CORRECTION

PATENT NO. : 5,096,513

DATED : March 17, 1992

INVENTOR(S) : SAWA et al.

It is certified that error appears in the above-indentified patent and that said Letters Patent is hereby corrected as shown below:

On drawing

Sheet 4 of 4, Fig. 5, contains a typographical error wherein "LESS" should read --LOSS--.

Column 5, line 14, contains a typographical error wherein "$Fe_{100-e-f-g-h-i-j}E_eG_fH_gSi_hB_iZ_j$" should read --$Fe_{100-e-f-g-h-i-j}E_eG_f\underline{J}_gS_{iu}B_iZ_j$--;

line 21, delete "of" (first occurrence);

line 59, delete ",".

Column 6, line 46, "showed" should read --shown--.

UNITED STATES PATENT AND TRADEMARK OFFICE

CERTIFICATE OF CORRECTION

PATENT NO. : 5,096,513

DATED : March 17, 1992

INVENTOR(S) : SAWA et al.

It is certified that error appears in the above-indentified patent and that said Letters Patent is hereby corrected as shown below:

Column 7, line 23, "$(CO_{1-m-n}L_mM_n)_{100-o}(Si_{1-p}B_p)_o$" should read --$(CO_{1-m-n}L_mM_n)_{100-o}(Si_{1-p}B_p)_o$--;

line 26, "on" should read --one--;

line 31, "O" (first occurrence) should read --o--; "P" should read --p--.

Column 8, line 67, "quence" should read --quench--.

Table 1, Columns 9 and 10, line 38, "8" should read --18--;

line 39, "$(CO_{0.905}Fe_{0.05}Nb_{0.02}Cr_{0.25})_{75}$" should read --$(CO_{0.905}Fe_{0.05}Nb_{0.02}Cr_{0.025})_{75}$--.

Column 11, line 2, "KG" should read --kG--;

line 44, "corrosionresistance" should read --corrosion resistance--.

UNITED STATES PATENT AND TRADEMARK OFFICE

CERTIFICATE OF CORRECTION

PATENT NO. : 5,096,513

DATED : March 17, 1992

INVENTOR(S) : SAWA et al.

It is certified that error appears in the above-indentified patent and that said Letters Patent is hereby corrected as shown below:

Column 12, line 12, "corrosionresistance" should read --corrosion resistance--;

line 65, "sued" should read --used--.

Column 13, line 16, "molted" should read --molten--.

Column 15, line 50, "tow" should read --two--.

UNITED STATES PATENT AND TRADEMARK OFFICE

CERTIFICATE OF CORRECTION

PATENT NO. : 5,096,513

DATED : March 17, 1992

INVENTOR(S) : SAWA et al

It is certified that error appears in the above-indentified patent and that said Letters Patent is hereby corrected as shown below:

Column 16, Table 3, line 15, "Permeabilith" should read --Permeability--.

Column 17, line 8, Claim 7, "$_{m-n}L_mM_n)_{100-Q}Si_{1-p}B_p)_O$" should read --$_{m-n}L_mM_n)_{100-Q}\{Si_{1-p}B_p)_Q$--.

Signed and Sealed this

Thirty-first Day of January, 1995

Bruce Lehman

*Attest:*

BRUCE LEHMAN

*Attesting Officer*

*Commissioner of Patents and Trademarks*